US008359878B2

(12) United States Patent
Kim et al.

(10) Patent No.: US 8,359,878 B2
(45) Date of Patent: Jan. 29, 2013

(54) METHOD OF ASSEMBLING A REFRIGERATOR

(75) Inventors: Myung-Soo Kim, Gimhae (KR); Yoo-Min Park, Jinju (KR); Oh-Chul Kwon, Gimhae (KR); Jong-Gon Kim, Changwon (KR); Bon-Young Koo, Changwon (KR); Young-Hoon Gwak, Busan (KR); Hyeon-Po Cho, Busan (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/209,180

(22) Filed: Aug. 12, 2011

(65) Prior Publication Data

US 2011/0296689 A1 Dec. 8, 2011

Related U.S. Application Data

(62) Division of application No. 12/160,753, filed as application No. PCT/KR2007/001420 on Mar. 23, 2007, now Pat. No. 8,234,880.

(30) Foreign Application Priority Data

Mar. 23, 2006 (KR) ..... 10-2006-0026660
Mar. 23, 2006 (KR) ..... 10-2006-0026661
Mar. 23, 2006 (KR) ..... 10-2006-0026663
Mar. 23, 2006 (KR) ..... 10-2006-0026664

(51) Int. Cl.
*F25C 5/18* (2006.01)
*F25D 25/00* (2006.01)
*F25D 3/02* (2006.01)

(52) U.S. Cl. ..... 62/344; 62/377; 62/420; 62/424; 62/425

(58) Field of Classification Search ..... 62/340, 62/344, 377, 407, 420, 424, 425, 449
See application file for complete search history.

(56) References Cited

U.S. PATENT DOCUMENTS

| | | | | |
|---|---|---|---|---|
| 4,997,109 | A | 3/1991 | Carper | |
| 6,050,097 | A | 4/2000 | Nelson et al. | |
| 6,442,954 | B1 | 9/2002 | Shapiro et al. | |
| 7,188,479 | B2 * | 3/2007 | Anselmino et al. | 62/66 |
| 7,469,553 | B2 | 12/2008 | Wu et al. | |
| 2006/0086130 | A1 | 4/2006 | Anselmino et al. | |
| 2007/0113578 | A1 * | 5/2007 | Wu et al. | 62/344 |

FOREIGN PATENT DOCUMENTS

| | | | |
|---|---|---|---|
| AU | 2005225155 | A1 | 5/2006 |
| JP | 06-011228 | A | 1/1994 |
| JP | 2003-106735 | A | 4/2003 |
| JP | 2005-009784 | A | 1/2005 |
| KR | 10-2005-0077558 | A | 8/2005 |
| KR | 10-2005-0094672 | A | 9/2005 |
| KR | 10-2005-0110212 | A | 11/2005 |
| KR | 10-2007-0096375 | A | 3/2006 |
| KR | 10-2007-0096376 | A | 3/2006 |
| KR | 10-2007-0096377 | A | 3/2006 |
| KR | 10-2007-0096374 | A | 10/2007 |
| RU | 3638 | U1 | 2/1997 |

* cited by examiner

*Primary Examiner* — Mohammad Ali
*Assistant Examiner* — Daniel C Comings
(74) *Attorney, Agent, or Firm* — Birch, Stewart, Kolasch & Birch, LLP

(57) ABSTRACT

A method of assembling a refrigerator including providing a main body having a storage chamber, providing a door having a door liner on one side of the door, providing a seating member, providing an ice maker for making ice, attaching the ice maker to the seating member, attaching the seating member to the door liner, providing an ice bank for storing ice, attaching the ice bank to the seating member below the ice maker, and rotatably attaching the door to the main body.

9 Claims, 6 Drawing Sheets

METHOD OF ASSEMBLING A REFRIGERATOR

This application is a Divisional of application Ser. No. 12/160,753 filed on Nov. 10, 2008 now U.S. Pat. No. 08234880 and for which priority is claimed under 35 U.S.C. §120. Application Ser. No. 12/160,753 is the national phase of PCT International Application No. PCT/KR2007/001420 filed on Mar. 23, 2007 under 35 U.S.C. §371. The entire contents of each of the above-identified applications are hereby incorporated by reference.

TECHNICAL FIELD

The present invention relates to a refrigerator, and more particularly, to an ice-making device for a refrigerator that is installed on a backside of a door to make ice.

BACKGROUND ART

FIG. 8 is a side sectional view illustrating a major portion of a refrigerator provided with a conventional ice-making device.

As illustrated in the figure, an inner case 12 is coupled to the inside of an outer case 11 defining the external appearance of a refrigerator main body 10. The inner case 12 is to define the inside of the main body 10, and a freezing chamber 13 that is a storage space is substantially defined by the inner case 12.

Provided on one side of the main body 10 is a door 15 for selectively opening or closing the freezing chamber 13. The door 15 is installed to the main body 10 to be pivotable on one end thereof so that the other end thereof is moved in the fore and aft direction. The door 15 includes an outer door 16 and a door liner 17. The outer door 16 defines the front external appearance of the door 15. Furthermore, the door liner 17 defines the backside external appearance of the door 15.

A shroud 19 is provided inside the freezing chamber 13. The shroud 19 is positioned to be spaced apart by a predetermined distance from the rear side of the freezing chamber 13. Furthermore, the shroud 19 is formed with a plurality of cold air discharge holes 19A through which cold air is discharged into the freezing chamber 13.

Meanwhile, a heat exchange chamber 21 is formed between the rear side of the freezing chamber 13 and the backside of the shroud 19. The lower part of the heat exchange chamber 21 is provided with an evaporator (not shown) for generating cold air. Furthermore, the upper part of the heat exchange chamber 21 is provided with an air-blowing fan 23 for discharging cold air, which is heat-exchanged in the evaporator, to the freezing chamber 13.

An ice maker 25 is provided in the upper part of the rear side of the freezing chamber 13 corresponding to the front of the air-blowing fan 23. The ice maker 25 is installed to extend from side to side on the upper part of the freezing chamber 13 adjacent to the shroud 19. The ice maker 25 serves to make ice and transfer it to an ice bank 31, which will be described later.

A motor casing 27 is installed on one side of the freezing chamber 13 below the ice maker 25. A feed motor 20 for driving a feed lever 31A to be described later is provided in the motor casing 17.

The ice bank 31 is provided in the freezing chamber 13 corresponding to the front of the motor casing 27. The ice bank 31 serves to transfer the ice received from the ice maker 25 to a dispenser (not shown) and to enable a user to take out the ice from the outside. To this end, the feed lever 31A driven by a feed motor 29 is provided in the ice bank 31. One end of the feed lever 31 A is connected to a drive shaft of the feed motor 29.

However, the conventional refrigerator so configured has the following problems.

As described above, in the prior art, the ice maker 25 is installed on the rear side of the freezing chamber 13 to extend from side to side. Furthermore, in order to transfer the ice made in the ice maker 25 to the dispenser, the motor casing 27 and the ice bank 31 are respectively provided in the freezing chamber 13. Hence, there is a disadvantage in that a storage capacity of the freezing chamber 13 is reduced as much as a volume of the ice maker 25, the motor casing 27 and the ice bank 31.

Furthermore, since the ice maker 25 is installed in the freezing chamber 13, the ice maker 25 makes ice by means of cold air circulating in the freezing chamber 13. Hence, in a process of making ice in the ice maker 25, smell of other food stored in the freezing chamber 13 can permeate the ice.

Disclosure

Technical Problem

The present invention is conceived to solve the aforementioned problems in the prior art. An object of the present invention is to provide an ice-making device for a refrigerator that is configured to prevent the lowering of a storage capacity of a refrigerator.

Another object of the present invention is to provide an ice-making device for a refrigerator that is configured to minimize the phenomenon that smell of other food stored in the refrigerator permeates ice.

Technical Solution

According to an aspect of the present invention for achieving the objects, there is provided a An ice-making device for a refrigerator including a main body having a storage space and a door selectively opening or closing the storage space, the ice-making device comprising: an ice maker installed on a backside of the door and making ice; and a cold air duct provided in one side of the storage space and supplying the ice maker with a portion of cold air supplied to the storage space.

At this time, the cold air duct is formed to extend in its longitudinal direction and is provided on a ceiling of the storage space to extend in a fore and aft direction.

Further, wherein a support rib is provided on an inside of a rear end of the cold air duct, the support rib having an underside supported on a top side of a fastening rib provided on a front side of a shroud, the shroud being spaced from a rear side of the storage space by a predetermined distance; and a fastening boss is provided on a front end of the cold air duct, the fastening boss being formed with a through hole through which a fastener fastened to a fastening hole formed in the ceiling of the storage space passes.

Preferably a fastening protrusion inserted into a fastening recess formed in the ceiling of the storage space is further provided in a front end of the cold air duct.

At this time cold air inlet could be formed in a rear end of the cold air duct, the cold air inlet communicating with a cold air discharge hole formed in the shroud, which is spaced apart from a rear side of the storage space by a predetermined distance; and a cold air outlet for supplying cold air to the ice maker through a cold air introduction hole is formed in a front end of the cold air duct, the cold air introduction hole being formed in an ice maker cover, the ice maker cover being detachably installed on the backside of the door to selectively open or close the ice maker.

At this time an auxiliary cold air outlet for discharging a portion of cold air introduced through the cold air inlet to the storage space is further provided in one side of the cold air duct.

And the ice-making device, further comprise an ice maker cover detachably installed on the backside of the door to selectively open or close the ice maker of an ice bank detachably installed on the backside of the door below the ice maker, the ice bank storing ice made in the ice maker and transferring it to a dispenser provided on the door.

According to another aspect of the present invention, there is provided An ice-making device for a refrigerator including a main body having a storage space and a door selectively opening or closing the storage space, the ice-making device comprising: an ice maker installed on a backside of the door and making ice; and an ice maker cover detachably installed on the backside of the door to selectively open or close the ice maker.

Preferably fixing recesses opened downwardly into which fixing protrusions are inserted are formed in the outsides of both sides of the ice maker cover, respectively, the fixing protrusions being provided at their corresponding positions on side surfaces of a pair of support steps facing each other, the support steps being formed to protrude rearward by a predetermined length from both side ends of the backside of the door and to vertically extend.

At this time a fastening hook elastically fastened to the backside of the door is provided on a lower end of a rear side of the ice maker cover adjacent to the backside of the door.

Preferably a cold air introduction hole into which cold air to be supplied to the ice maker is introduced is formed in a top side of the ice maker cover.

At this time a plurality of blades for guiding cold air to be supplied to the ice maker are further provided in the cold air introduction hole.

Preferably the blades are inclined at a predetermined angle with respect to the vertical axis to guide cold air to the ice maker along a shortest route.

At this time one of the blades that is positioned most adjacent to the ice maker has an inclination angle of 45 degrees with respect to the vertical axis, another one of the blades that is positioned to be furthest spaced from the ice maker has an inclination angle of 70 degrees with respect to the vertical axis, and the others of the blades respectively have inclination angles that are gradually increased between 45 and 70 degrees with respect to the vertical axis as they become further away from the ice maker.

Preferably a portion of cold air supplied to the storage space through a cold air outlet of a cold air duct is introduced into the cold air introduction hole, the cold air duct being provided on the ceiling of the storage space to extend in a fore and aft direction.

At this time the cold air duct is downwardly inclined at a predetermined slope from a front end thereof, in which the cold air outlet is formed, toward a rear end thereof adjacent to a rear end of the storage space; a top side of the ice maker cover in which the cold air introduction hole is formed is downwardly inclined from a rear end thereof adjacent to the backside of the door toward a front end thereof to mate with the cold air duct in shape; and the cold air duct and the ice maker cover are positioned to mate with each other in shape in a state where the door closes the storage space, whereby the cold air outlet and the cold air introduction hole communicate with each other.

According to another aspect of the present invention, there is provided an ice-making device for a refrigerator including a main body having a storage space and a door selectively opening or closing the storage space, the ice-making device comprising: an ice maker installed on a backside of the door and making ice; and an ice bank detachably installed on the backside of the door below the ice maker, the ice bank storing ice made in the ice maker and transferring it to a dispenser provided on the door.

The ice-making device is further comprising a seating member installed in a space, which is defined by the backside of the door, side surfaces of a pair of support steps facing each other and a seating step, the support steps being formed to protrude rearward from both side ends of the backside of the door by a predetermined length and to extend vertically, the seating step being formed to extend from side to side in such a manner that a portion of the backside of the door between the support steps protrudes rearward by a predetermined length, the seating member being provided with an installation space in which the ice maker and the ice bank are installed.

At this time at least one catching recess, into which at least one catching protrusion provided on a bottom side of the installation space is inserted, is formed in an underside of the ice bank.

Further the underside of the ice maker and an upper end circumference of the ice bank are spaced apart from each other by a distance smaller than the height of the catching protrusion; a rear side of the ice bank is spaced from a front side of the installation space by a predetermined distance; and if the ice bank is moved to be upwardly inclined toward the front side of the installation space in a state where an upper end of the rear side thereof is rotated about a lower end thereof to be adjacent to the front side of the installation space, the catching protrusion is separated from the catching recess, whereby the ice bank is detachable from the installation space.

And a round portion can be provided in a lower end of the rear side of the ice bank, the round portion causing the ice bank to be easily rotated about the lower end thereof in a direction in which the upper end of the rear side thereof becomes adjacent to the front side of the installation space.

Preferably a catching rib positioned adjacent to the upper end of the rear side of the ice bank is provided on the front side of the installation space; and if the ice bank is rotated about the lower end thereof in a direction in which the upper end thereof becomes spaced apart from the front side of the installation space, the upper end of the rear side of the ice bank is caught to the catching rib, whereby the ice bank is prevented from being inadvertently detached from the installation space.

And the ice-making device is further comprising a cold air duct provided in one side of the storage space and supplying the ice maker with a portion of cold air supplied to the storage space.

And the ice-making device is further comprising an ice maker cover detachably installed on an upper part of the installation space so that upper and lower end circumferences of the ice bank are spaced apart from each other by a predetermined distance, the ice maker cover selectively opening or closing the ice maker.

According to another aspect of the present invention, there is provided An ice-making device for a refrigerator including a main body having a storage space and a door selectively opening or closing the storage space, the ice-making device comprising: an ice maker installed on a backside of the door and making ice; and a seating member installed in a space, which is defined by the backside of the door, side surfaces of a pair of support steps facing each other and a seating step, the support steps being formed to protrude rearward from both side ends of the backside of the door by a predetermined length and to extend vertically, the seating step being formed to extend from side to side in such a manner that a portion of the backside of the door between the support steps protrudes rearward by a predetermined length, the seating member being provided with an installation space in which the ice maker is installed.

And the ice-making device can be further comprising a cold air guide provided on the backside of the door and guiding a portion of cold air supplied to the storage space to the ice maker.

At this time, the cold air guide is configured in a pair and provided to vertically extend on one side of the seating member corresponding to the front side of the installation space.

Preferably, the seating member includes a front plate having a backside brought into contact with the backside of the door between the support steps, both side plates provided on both side ends of the front plate and having outer surfaces brought into contact with side surfaces of the support steps facing each other, respectively, and a bottom plate provided on lower ends of the front and side plates and having a bottom side brought into contact with a top side of the seating step.

And fixing recesses opened downwardly into which fixing protrusions are inserted are formed in the outer surfaces of both the side plates, respectively, the fixing protrusions being provided at their corresponding positions on the side surfaces of the support steps facing each other, and a through hole, through which a fastener to be fastened to a fastening hole formed in the top side of the seating step passes, is formed in the bottom plate.

And a pair of mounting brackets in each of which a through hole can be formed are provided on one side of the ice maker; and the front plate is formed with a pair of fastening holes to which fasteners penetrating the through holes of the mounting brackets are fastened.

And the ice-making device can be further comprising an ice maker cover detachably installed on the backside of the door to selectively open or close the ice maker.

And the ice-making device can be further comprising an ice bank detachably installed in the installation space below the ice maker, the ice bank storing ice made in the ice maker and transferring it to a dispenser provided on the door.

According to another aspect of the present invention, there is provided An ice-making device for a refrigerator including a main body having a storage space and a door selectively opening or closing the storage space, the ice-making device comprising: an ice maker installed on a backside of the door and making ice; a cold air duct provided in one side of the storage space and supplying the ice maker with a portion of cold air supplied to the storage space; an ice maker cover detachably installed on the backside of the door to selectively open or close the ice maker; and an ice bank detachably installed on the backside of the door below the ice maker, the ice bank storing ice made in the ice maker and transferring it to a dispenser provided on the door.

At this time the cold air duct is formed to extend in its longitudinal direction and is provided on a ceiling of the storage space to extend in a fore and aft direction; a cold air inlet into which cold air flowing in the storage space is introduced is formed in a rear end of the cold air duct; and a cold air outlet for supplying cold air to the ice maker is formed in a front end of the cold air duct.

And a cold air introduction hole into which cold air to be supplied to the ice maker is introduced is formed in a top side of the ice maker cover.

And a front end of the cold air duct in which the cold air outlet is formed and a top side of the ice maker cover on which the cold air introduction hole is formed are shaped to mate with each other in a state where the door closes the storage space.

And a plurality of blades for guiding cold air to be supplied to the ice maker are further provided in the cold air introduction hole.

And the blades are inclined at a predetermined angle with respect to the vertical axis to guide cold air to the ice maker along a shortest route.

At this time, further comprising a seating member installed in a space, which is defined by the backside of the door, side surfaces of a pair of support steps facing each other and a seating step, the support steps being formed to protrude rearward from both side ends of the backside of the door by a predetermined length and to extend vertically, the seating step being formed to extend from side to side in such a manner that a portion of the backside of the door between the support steps protrudes rearward by a predetermined length, the seating member being provided with an installation space in which the ice maker, the ice maker cover and the ice bank are installed.

Preferably a cold air guide for guiding cold air to the ice maker is further provided on the seating member, the cold air being supplied by the cold air duct and the ice maker cover.

Advantageous Effects

According to the ice-making device of the present invention so configured, there is an advantageous in that a storage capacity of a refrigerator can be used to the full extent, and smell of food can be prevented from permeating ice in a process of making ice.

BEST MODE

Hereinafter, preferred embodiments of an ice-making device for a refrigerator according to the present invention will be described in detail with reference to the accompanying drawings.

Figure 1:
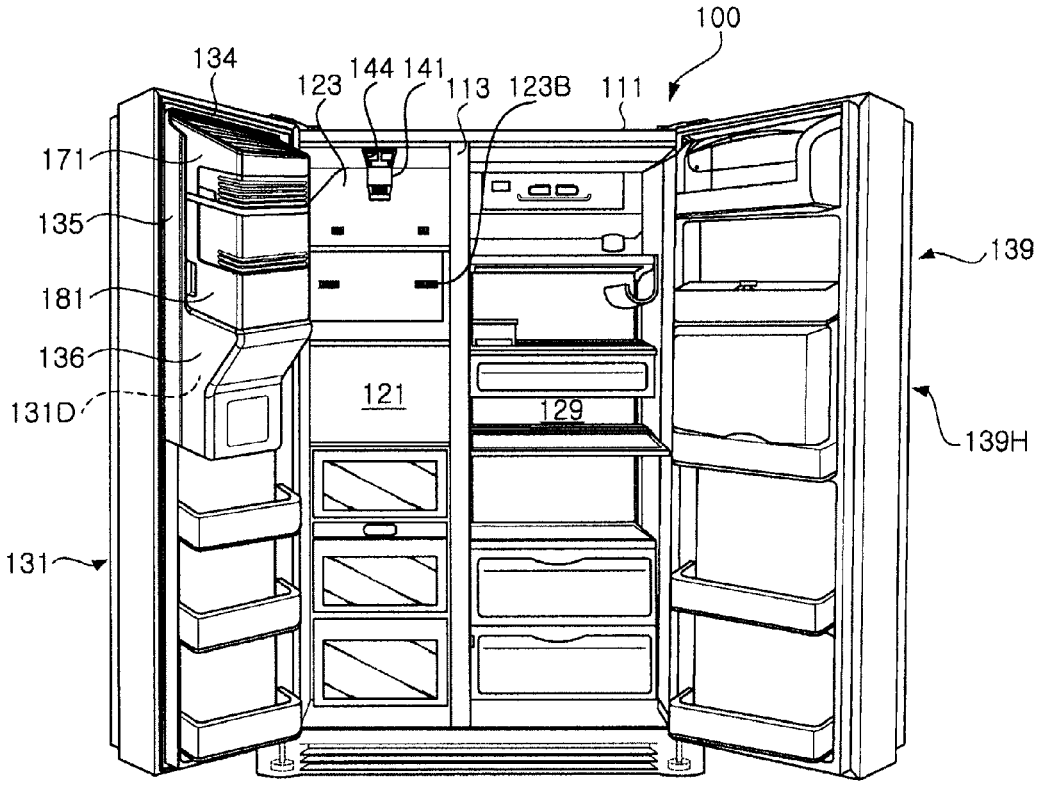
FIG. 1 is a perspective view illustrating a refrigerator in which a preferred embodiment of an ice-making device for a refrigerator according to the present invention is employed.
Figure 2:
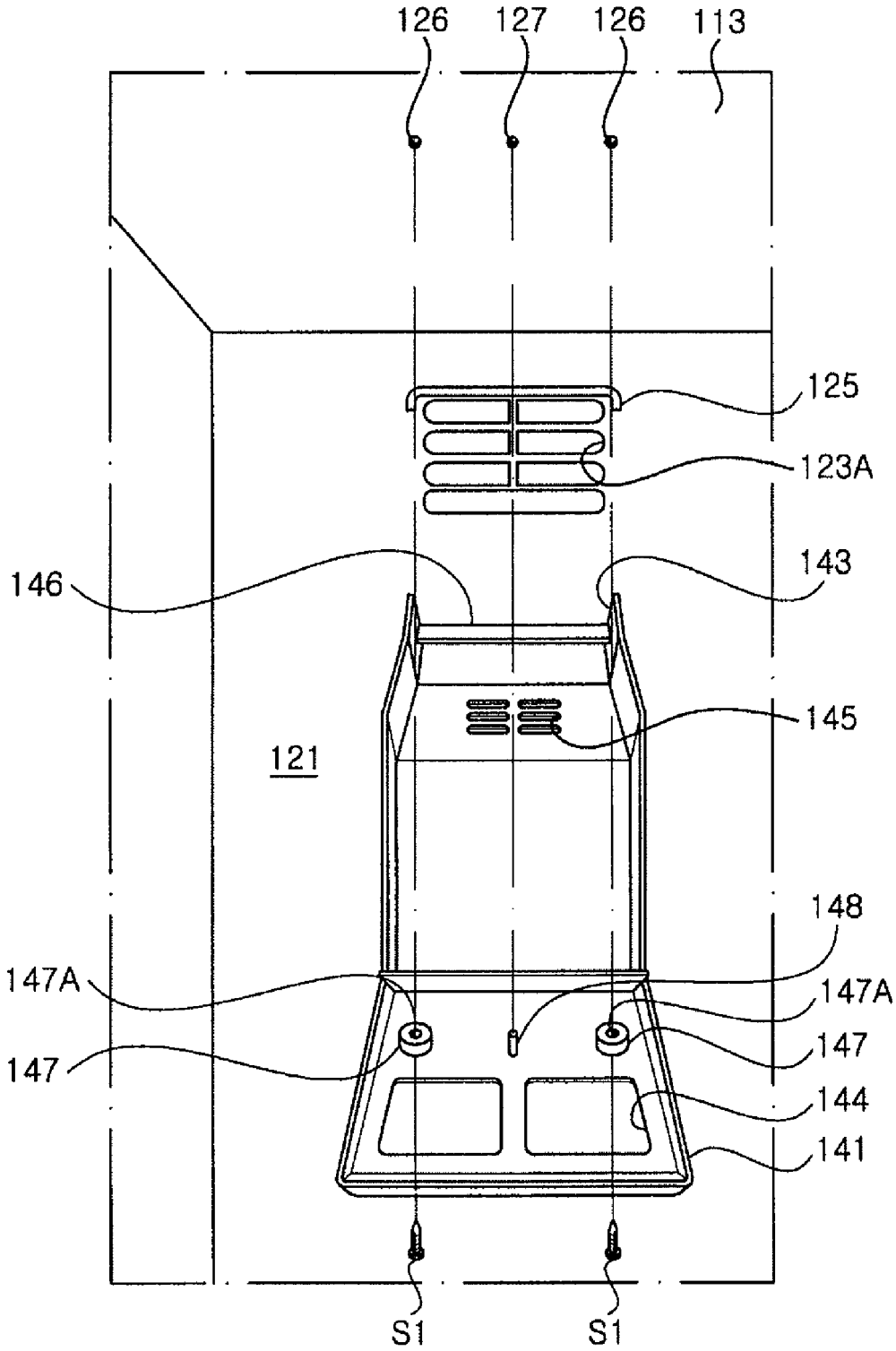
FIG. 2 is an exploded perspective view illustrating a major portion of the preferred embodiment of the present invention.
Figure 3:
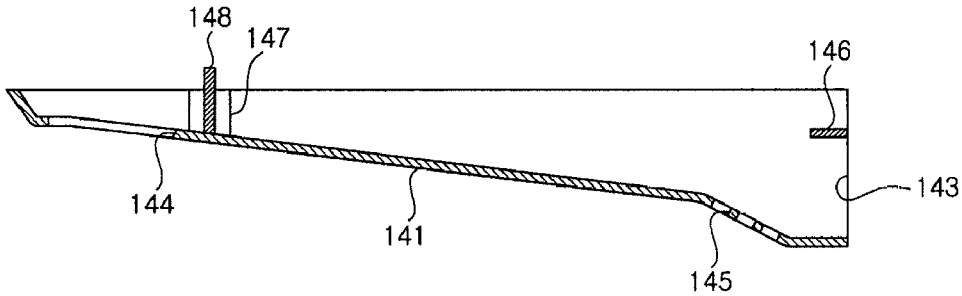
FIG. 3 is a side sectional view illustrating a cold air duct constituting the preferred embodiment of the present invention.
Figure 4:
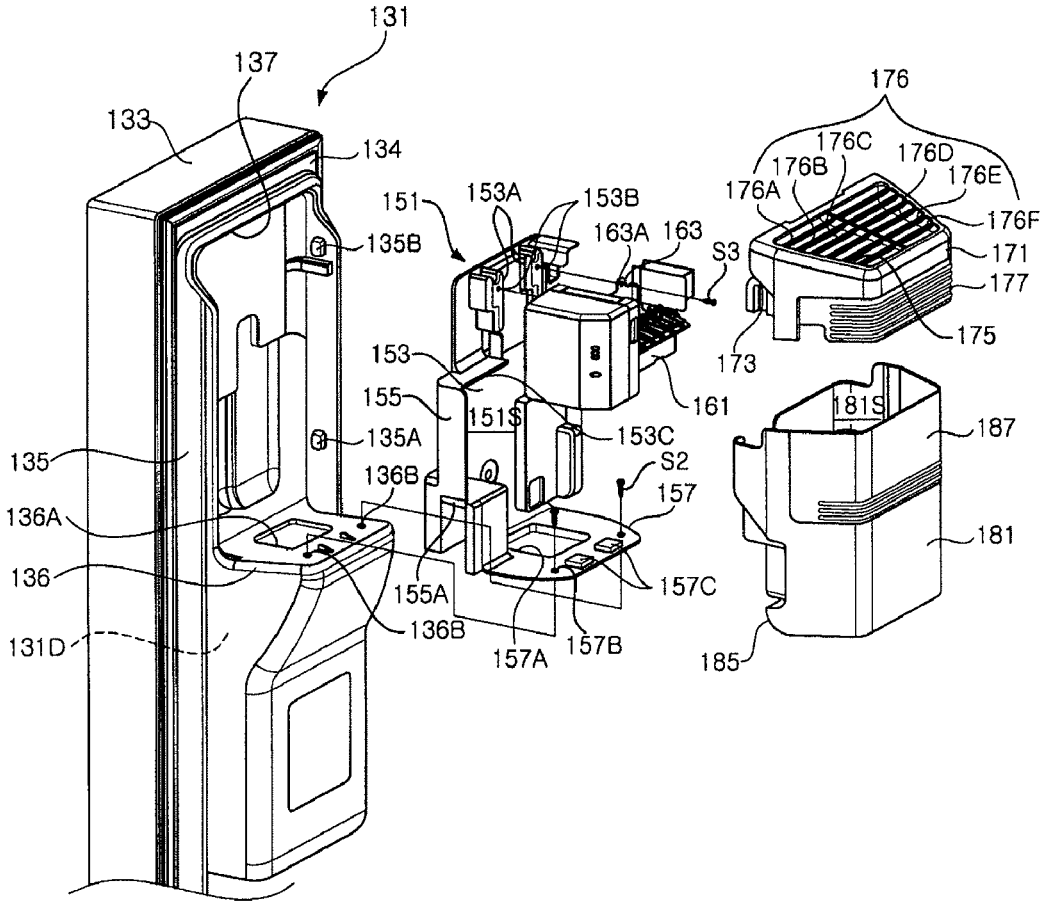
FIG. 4 is an exploded perspective view illustrating another major portion of the preferred embodiment of the present invention.
Figure 5:
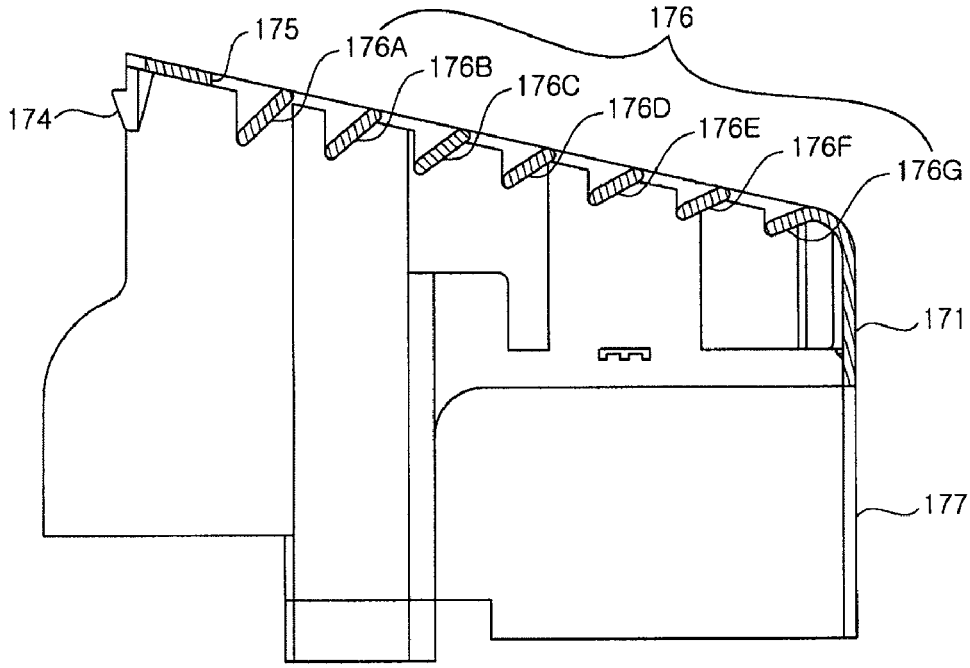
FIG. 5 is a side sectional view illustrating an ice maker cover constituting the preferred embodiment of the present invention.
Figure 6:
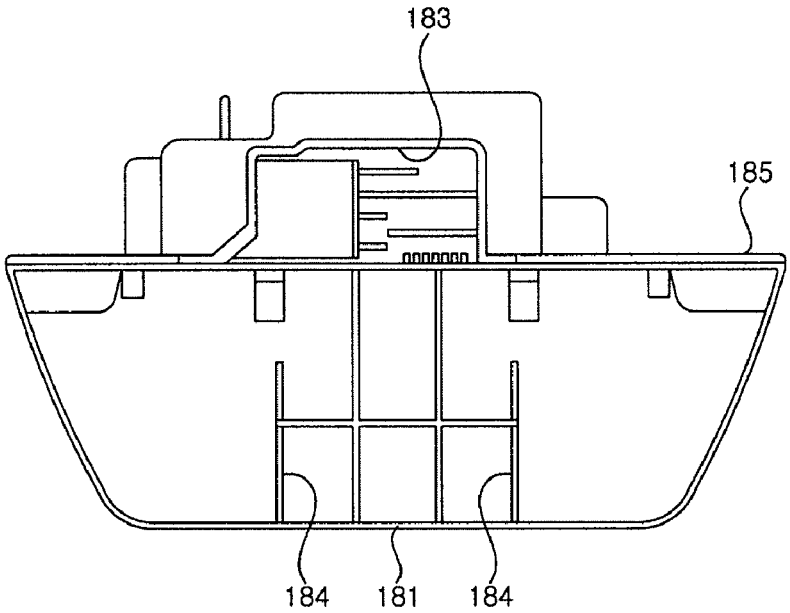
FIG. 6 is a plan view illustrating the underside of an ice bank constituting the preferred embodiment of the present invention.

FIG. 1 is a perspective view illustrating a refrigerator in which a preferred embodiment of an ice-making device for a refrigerator according to the present invention is employed, FIG. 2 is an exploded perspective view illustrating a major portion of the preferred embodiment of the present invention, FIG. 3 is a side sectional view illustrating a cold air duct constituting the preferred embodiment of the present invention, FIG. 4 is an exploded perspective view illustrating another major portion of the preferred embodiment of the present invention, FIG. 5 is a side sectional view illustrating an ice maker cover constituting the preferred embodiment of the present invention, and FIG. 6 is a plan view illustrating the underside of an ice bank constituting the preferred embodiment of the present invention.

As illustrated in the figures, a freezing chamber 121 and a refrigerating chamber 127 are provided in a refrigerator main body 100 so that they stand side by side. Furthermore, an outer case 111 defines the external appearance of the main body 100. An inner case 113 defining the inside of the main body 100 is coupled to the inside of the outer case 111. That is, the freezing chamber 121 and the refrigerating chamber 127 are defined by the inner case 113.

Meanwhile, a freezing chamber door 131 and a refrigerating chamber door 139 are provided on the main body 100. Each of the freezing chamber door 131 and the refrigerating chamber door 139 is installed to be pivotable on one end thereof so that a leading end thereof is moved in the fore and aft direction. The freezing chamber door 131 and the refrigerating chamber door 139 serve to selectively open or close the freezing chamber 121 and the refrigerating chamber 127, respectively.

Furthermore, the freezing chamber door 131 and the refrigerating chamber door 139 are provided with a dispenser 131D and a home-bar 139H, respectively. The dispenser 131D is to enable a user to take out water or ice from the outside without opening the freezing chamber door 131. The home-bar 139H is to enable a user to take out beverage from the outside without opening the refrigerating chamber door 139.

A shroud 123 is provided in the freezing chamber 121. At this time, the shroud 123 is positioned so that the backside thereof is spaced apart from the rear side of the freezing chamber 121 by a predetermined distance. Furthermore, a heat exchange chamber 124 (see FIG. 7), in which an evaporator (not shown), an air-blowing fan (not shown) and the like are installed, is defined between the rear side of the freezing chamber 121 and the backside of the shroud 123.

Meanwhile, a plurality of cold air discharge holes 123A (see FIG. 2) and 123B are formed in the shroud 123. The cold air discharge holes 123A and 123B are portions through which cold air heat-exchanged in the evaporator is discharged into the freezing chamber 121 by driving the air-blowing fan. The cold air discharge holes 123A and 123B are formed in the shroud 123 so that they are vertically or laterally spaced apart from each other.

As illustrated in FIG. 2 in detail, a fastening rib 125 is provided on the front side of the shroud 123 above the cold air discharge hole 123A, which is positioned in the uppermost part of the freezing chamber 121, among the cold air discharge holes 123A and 123B. The fastening rib 125 protrudes from the front side of the shroud 123 in the forward direction and is provided to extend from side to side. At this time, it is preferred that both ends of the fastening rib 125 be round to be inclined downwardly.

Meanwhile, the ceiling of the freezing chamber 121 is formed with a pair of fastening holes 126 and a fastening recess 129. The fastening holes 126 and the fastening recess 129 of the freezing chamber 121 are provided in the front end of the ceiling of the freezing chamber 121 corresponding to the front of the cold air discharge hole 123A and the fastening rib 125. At this time, it is preferred that the fastening recess 129 of the freezing chamber 121 be provided between the fastening holes 126 of the freezing chamber 121.

The ceiling of the freezing chamber 121 is provided with a cold air duct 141. The cold air duct 141 causes a portion of cold air discharged through the cold air discharge hole 123A to flow toward the backside of the freezing chamber door 131, and thus, serves to substantially supply the cold air to an ice maker 161, which will be described later.

To this end, the cold air duct 141 is formed to extend in the longitudinal direction and to have a side cross section of a "⊏" shape with the top portion opened. Hence, a flow passage, in which cold air supplied to the ice maker 161 substantially flows, is defined by the ceiling of the freezing chamber 121 and the inside of the cold air duct 141.

As illustrated in FIG. 3, it is preferred that the height of the cold air duct 141 be gradually increased from the front end thereof to the rear end thereof. That is, the cold air duct 141 is inclined at a predetermined slope downwardly from its front end to its rear end. This is to enable cold air to be supplied efficiently by reducing the cross section of the flow passage defined by the ceiling of the freezing chamber 121 and the inside of the cold air duct 141 as it gets away from the cold air discharge hole 123A. Furthermore, the height of the rear end of the cold air duct 141 is relatively larger than at least the overall height of the cold air discharge hole 123A.

The cold air duct 141 is installed on the ceiling of the freezing chamber 121 to extend in the fore and aft direction. At this time, the rear end of the cold air duct 141 is brought into contact with the front side of the shroud 123 so that the cold air discharge hole 123A is positioned in the cold air duct. In addition, the front end of the cold air duct 141 is positioned adjacent to the front end of the ceiling of the freezing chamber 121.

A cold air inlet 143 is formed in the rear end of the cold air duct 141. The cold air inlet 143 serves as an inlet through which cold air discharged through the cold air discharge hole 123A is introduced into the cold air duct 141.

Further, a cold air outlet 144 is formed in the front end of the cold air duct 141. The cold air outlet 144 serves as an outlet through which cold air introduced into the cold air duct 141 through the cold air inlet 143 is discharged to be introduced into a cold air introduction hole 175 of an ice maker cover 171, which will be described later. However, as described above, the height of the cold air duct 141 is gradually increased from its front end to its rear end. Hence, the cold air outlet 144 is downwardly inclined toward the front of the freezing chamber 121.

Moreover, an auxiliary cold air outlet 145 is provided in the rear end of the cold air duct 141 adjacent to the cold air inlet 143. The auxiliary cold air outlet 145 serves to discharge a portion of cold air, which is introduced into the cold air duct 141 through the cold air discharge hole 123A, into the freezing chamber 121.

Meanwhile, a support rib 146 is provided on the inside of the rear end of the cold air duct 141. The support rib 146 is formed on the rear end of the cold air duct 141 to extend from side to side. Furthermore, in a state where the cold air duct 141 is installed on the ceiling of the freezing chamber 121, the bottom of the support rib 146 is supported on the top side of the fastening rib 125.

In addition, a pair of fastening bosses 147 are provided on the inside of the front end of the cold air duct 141 corresponding to the front of the cold air outlet 144. The fastening bosses 147 protrude upwardly from the inside of the front end of the cold air duct 141, so that leading ends of the fastening bosses are brought into contact with the ceiling of the freezing chamber 121. The fastening bosses 147 are laterally spaced apart from each other by a predetermined distance. Furthermore, a through hole 147A, through which a fastening screw S1 to be fastened to the fastening hole 126 of the freezing chamber 121 passes, is formed in each of the fastening bosses 147.

A fastening protrusion 148 is provided on the inside of the front end of the cold air duct 141 between the fastening bosses 147. The fastening protrusion 148 protrudes upwardly from the inside of the front end of the cold air duct 141. At this time, the fastening protrusion 148 is formed longer than the fastening boss 147 and is thus inserted into the fastening recess 129 of the freezing chamber 121.

Meanwhile, as illustrated in FIG. 4 in detail, an outer door 133 defines the front external appearance of the freezing chamber door 131. In addition, a door liner 134 defining the rear external appearance of the freezing chamber door 131 is coupled to the inside of the outer door 133.

Moreover, support steps 135 are respectively provided on both side ends of the backside of the freezing chamber door 131. A portion of the door liner 134 protrudes rearward by a predetermined length, so that each support step 135 is formed to vertically extend. A plurality of fixing protrusions 135A and 135B are provided at their corresponding positions on side surfaces of the support steps 135 facing each other.

Furthermore, a seating step 136 is provided on the backside of the freezing chamber 131. The seating step 136 is formed in such a manner that a portion of the door liner 134 between the support steps 135 protrudes rearward by a predetermined length. At this time, the seating step 136 protrudes relatively longer than the support step 135. In addition, the seating step 136 is substantially formed by installing the dispenser 131D.

In the meantime, a communication hole 136A is provided in the seating step 136. The communication hole 136A of the seating step 136 is formed in such a manner that a portion of the door liner 134 forming the seating step 136 is cut away. The communication hole 136A of the seating step 136 is to supply the ice made in the ice maker 161 to the dispenser 131D. Furthermore, a pair of fastening holes 136B are formed in the front end of the seating step 136.

Moreover, the backside of the freezing chamber door 131 is provided with a connection step 137. The connection step 137 is formed to extend from side to side in such a manner that a portion of the door liner 134 protrudes rearward by a predetermined length so as to connect the upper ends of the support steps 135.

A seating member 151 is provided on the backside of the freezing chamber door 131. The seating member 151 is formed in the shape of a polyhedron with a portion opened to have a predetermined installation space 151S provided therein. That is, the seating member 151 includes a front plate 153 defining the front surface of the installation space 151S, both side plates 155 defining both side surfaces of the installation space 151S, and a bottom plate 157 defining the bottom surface of the installation space 151S. The backside of the front plate 153 is brought into contact with the backside of the freezing chamber door 131 between the support steps 135. Outer surfaces of both the side plates 155 are respectively brought into contact with the side surfaces of the support steps 135 facing each other. Furthermore, the underside of the bottom plate 157 is brought into contact with the top side of the seating step 136.

The front side of the installation space 151S is provided with cold air guides 153A. The cold air guides 153A are to guide a portion of cold air, which is supplied to the ice maker 161 by the cold air duct 141, to a space between the installation space 151S and the ice maker 161. The cold air guides 153A are configured in a pair to be provided in the upper portion of the front side of the installation space 151S to vertically extend and to be laterally spaced apart from each other by a predetermined distance. In the illustrated embodiment, the cold air guides 153A are formed in such a manner that a portion of the front plate 153 defining the front side of the installation space 151S protrudes rearward.

Furthermore, a pair of fastening holes 153B are formed in the front side of the installation space 151S. It is preferred that the fastening holes 153B be formed in the upper portion of the front side of the installation space 151S corresponding to one side of the cold air guide 153A.

Moreover, a catching rib 153C is provided on the front side of the installation space 151S. The catching rib 153C is formed to horizontally extend from the upper ends of both side plates 155. In a state where an ice bank 181 to be described later is installed in the installation space 151S, the catching rib 153C is positioned on the trace that is formed by the upper end of the ice bank 181 in a process of rotating the upper end of the ice bank 181 about the lower end thereof in the direction in which the upper end becomes spaced apart from the front side of the installation space 151S.

Although not shown, a predetermined space in which various components for operating the dispenser 131D and the like are provided between the backside of the freezing chamber door 131 and the backside of the seating member 151, i.e., the backside of the front plate 153. Since such a space is not relevant to the subject matter of the present invention, the detailed description thereon will be omitted.

Meanwhile, fixing recesses 155A are formed in the outsides of both sides of the seating member 151 corresponding to the outsides of both sides of the installation space 151S, that is, on the outsides of the side plates 155, respectively. The fixing recess 155A of the seating member 151 is formed in an approximately "⊏" shape opened downwardly. The fixing protrusion 135A of the support step 135 is inserted into the fixing recess 155A of the seating member 151. Hence, if the seating member 151 is moved downwardly from the top, the fixing protrusion 135A of the support step 135 is inserted into the fixing recess 155A of the seating member 151, and thus, the seating member 151 is fastened to the backside of the freezing chamber door 131.

A communication hole 157A is provided in the bottom plate 157 corresponding to the bottom side of the installation space 151S. The communication hole 157A of the seating member 151 communicates with the communication hole 136A of the seating step 136. Hence, the ice passing through the communication hole 157A of the seating member 151 and the communication hole 136A of the seating step 136 is taken out to the outside through the dispenser 131D. The communication hole 157A of the seating member 151 is formed in such a manner that a portion of the bottom plate 157 is cut away.

In addition, a pair of through holes 157B are formed in the bottom plate 157 corresponding to the front end of the bottom side of the installation space 151S. The through hole 157B of the seating member 151 is a hole through which a fastening screw S2 to be fastened to the fastening hole 136B of the seating step 136 passes. Moreover, a pair of catching protrusions 157C are provided on the bottom plate 157 corresponding to the front end of the bottom side of the installation space 151S. Each of the catching protrusions 157C is formed in such a manner that a portion of the bottom plate 157 protrudes upwardly.

The ice maker 161 is provided on the upper part of the installation space 151S. The ice maker 161 serves to make ice to be taken out to the outside through the dispenser 131D. A pair of mounting brackets 163 are provided on one side of the ice maker 161. Each of the mounting brackets 163 is formed with a through hole 163A. A fastening screw S3 penetrating the through hole 163A of the ice maker 161 is fastened to the fastening hole 153B of the installation space 151S, so that the ice maker 161 is fastened to the installation space 151S.

Meanwhile, an ice maker cover 171 is detachably installed in the upper part of the installation space 151S. The ice maker cover 171 serves to selectively open or close the ice maker 161 and to allow cold air supplied through the cold air duct 141 to be transferred to the ice maker 161. Hence, in a state where the ice maker cover 171 is installed in the installation space 151S, the ice maker 161 is substantially positioned in the ice maker cover 171.

The ice maker cover 171 is formed in the shape of a polyhedron having the open lower side and one open side corresponding to the backside of the freezing chamber 131. Furthermore, fixing recesses 173 are formed in the outsides of both sides of the ice maker cover 171, respectively. The fixing recess 173 of the ice maker cover 171 is formed in a "⊏" shape opened downwardly. The fixing protrusion 135B of the support step 135 is inserted into the fixing recess 173 of the ice maker cover 171.

In addition, as illustrated in FIG. 5, a fastening hook 174 is provided on the rear side of the ice maker cover 171 that is brought into contact with the front side of the installation space 151S. The fastening hook 174 is formed to have predetermined elasticity, so that the ice maker cover 171 is elastically fastened to the connection step 137 in a state where the ice maker cover 171 is installed in the installation space 151S.

Meanwhile, the height of the ice maker cover 171 is gradually increased from the rear end thereof adjacent to the backside of the freezing chamber door 131 toward the front end thereof. Hence, the top side of the ice maker cover 171 is inclined downwardly at the same slope as the cold air duct 141 from the rear end thereof adjacent to the backside of the freezing chamber door 131 toward the front end thereof. That is, the cold duct 141 and the ice maker cover 171 are shaped to mate with each other. Accordingly, in a state where the freezing chamber door 131 closes the freezing chamber 121, the cold air duct 141 and the ice maker cover 171 are positioned to mate with each other in shape.

A cold air introduction hole 175 is formed in the top side of the ice maker cover 171. The cold air introduction hole 175 serves as an inlet into which cold air supplied through the cold air outlet 144 of the cold air duct 141 is introduced. In a state where the freezing chamber door 131 closes the freezing chamber 121, the cold air introduction hole 175 is formed in a position communicating with the cold air inlet 143 to have a size and shape corresponding to the cold air inlet 143.

The cold air introduction hole 175 is provided with a plurality of blades 176. The blades 176 serve to guide cold air, which is introduced through the cold air introduction hole 175, to the ice maker 161. Each of the blades 176 is inclined at a predetermined angle with respect to the vertical axis so as to guide cold air toward the ice maker 161 along the shortest route. Hence, an inclination angle of the blade 176 varies depending on a distance from the ice maker 161 and a position relative thereto.

For example, among the blades 176, the first blade 176A most adjacent to the ice maker 161 has an inclination angle of 45 degrees with respect to the vertical axis. Furthermore, among the blades 176, the seventh blade 176G furthest spaced from the ice maker 161 has an inclination angle of 70 degrees with respect to the vertical axis. Meanwhile, the second to sixth blades 176B to 176F positioned between the first blade 176A and the seventh blade 176G respectively have inclination angles that are gradually increased between 45 and 70 degrees with respect to the vertical axis as they become further away from the ice maker 161. That is, the second to sixth blades 176B to 176F have inclination angles of 49, 53, 57, 61 and 65 degrees with respect to the vertical axis, respectively.

In addition, the ice maker cover 171 is provided with a viewing window 177. The viewing window 177 of the ice maker cover 171 is formed of a transparent or translucent material. The viewing window 177 of the ice maker cover 171 is to view the process of making ice in the ice maker 161 with the naked eye in a state where a user does not detach the ice maker cover 171.

Referring to FIG. 4 again, the ice bank 181 is detachably installed to the lower part of the installation space 151S below the ice maker 161 and the ice maker cover 171. The ice made in the ice maker 161 is stored in the ice bank 181. Furthermore, the ice bank 181 transfers the stored ice to the dispenser 131D so as to enable a user to take out the ice from the outside.

The ice bank 181 is formed in the shape of a polyhedron having the same cross section as the ice maker cover 171. Furthermore, a storage space 181S of a hopper shape with an upper part opened is provided in the ice bank 181. The storage space 181S stores the ice made in the ice maker 161.

As illustrated in FIG. 6, an ice feeding opening 183 is provided in the underside of the ice bank 181. The ice feeding opening 183 serves as an outlet for transferring the ice stored in the storage space 181S to the dispenser 131D. That is, the ice stored in the storage space 181S is transferred to the dispenser 131D through the ice feeding opening 183, the communication hole 157A of the seating member 151 and the communication hole 136A of the seating step 136.

Meanwhile, a structure for feeding the ice stored in the storage space 181S through the ice feeding opening 183 is provided in the ice bank 181. Furthermore, a structure for pulverizing ice according to the user's selection is provided in the ice bank 181.

Moreover, a pair of catching recesses 184 are formed in the underside of the ice bank 181. The catching protrusions 157C are respectively inserted into the catching recesses 184. Hence, the ice bank 181 does not move inadvertently in the fore and aft direction of the installation space 151S in a state where the ice bank 181 is installed in the installation space 151S.

In addition, in a state where the ice bank 181 is installed in the installation space 151S, the upper end circumference of the ice bank 181 is spaced apart by a predetermined distance from the underside of the ice maker 161 and the lower end circumference of the ice maker cover 171. At this time, a gap between the lower end circumference of the ice maker cover 171 and the underside of the ice maker 161 and the upper end circumference of the ice bank 181 is designed to be relatively smaller than the height of the catching protrusion 157C. Furthermore, the rear side of the ice bank 181 is spaced apart from the front side of the installation space 151S by a predetermined distance.

This is to prevent the ice bank 181 from being inadvertently detached from the installation space 151S. That is, in a state where the ice maker 161 and the ice maker cover 171 are installed in the installation space 151S, the ice bank 181 cannot be moved vertically. Furthermore, since the catching protrusions 157C are inserted in the catching recesses 184, the ice bank 181 cannot also be moved in the fore and aft direction or the left and right direction.

Hence, in order to detach the ice bank 181 from the installation space 151S, the ice bank 181 is moved to be upwardly inclined in a state where the upper end of the rear side thereof is rotated to be adjacent to the front side of the installation space 151S, and then, the catching protrusions 157C are separated from the catching recesses 184. At this time, the ice bank 181 is moved until the upper end of the rear side thereof is brought into contact with one portion of the front side of the installation space 151S, and more specifically, a portion adjacent to an edge defined by the rear end of the underside of the ice maker 161 and the front side of the installation space 151S. In addition, the ice bank 181 is horizontally moved to be spaced apart from the front side of the installation space 151S, whereby the ice bank 181 can be detached from the installation space 151S. Furthermore, the ice bank 181 can be installed in the installation space 151S in the reverse order.

A round portion 185 is provided in the lower end of the rear side of the ice bank 181. The round portion 185 causes the ice bank 181 to be easily rotated about the lower end thereof in the direction in which the upper end of the rear side of the ice bank 181 becomes adjacent to the front side of the installation space 151S so that the ice bank 181 is mounted to or detached from the installation space 151S.

Meanwhile, a shock can be generated in the process of rotating the freezing chamber door 131. However, since the lower end of the ice bank 181 is restricted from moving due to the catching protrusion 157C and the catching recess 184, the ice bank 181 is rotated about the lower end thereof. That is, the ice bank 181 is rotated about the lower end thereof in the direction in which the upper end of the ice bank 181 becomes adjacent to or spaced apart from the front side of the installation space 151S.

However, the ice bank 181 is installed so that the rear side thereof is spaced apart from the front side of the installation space 151S by a predetermined distance. Hence, in the process of rotating the freezing chamber door 131, although the ice bank 181 is rotated about the lower end thereof in the direction in which the upper end thereof becomes adjacent to the front side of the installation space 151S, the ice bank 181 is not detached from the installation space 151S.

Furthermore, the upper end of the rear side of the ice bank 181 is positioned adjacent to the catching rib 153C. Hence, although the ice bank 181 is rotated about the lower end thereof in the direction in which the upper end thereof becomes spaced apart from the front side of the installation space 151S, the upper end of the rear side of the ice bank 181 is caught to the catching rib 153C, and thus, the ice bank 181 is not detached from the installation space 151S inadvertently.

In addition, the ice bank 181 is provided with a viewing window 187. The viewing window 187 of the ice bank 181 is formed of a transparent or translucent material like the viewing window 177. Moreover, a user can identify an amount of the ice stored in the storage space 181S through the viewing window 187 of the ice maker cover 171.

Hereinafter, the operation of an ice-making device for a refrigerator according to the preferred embodiment of the present invention will be described in detail with reference to the accompanying drawings.

Figure 7:
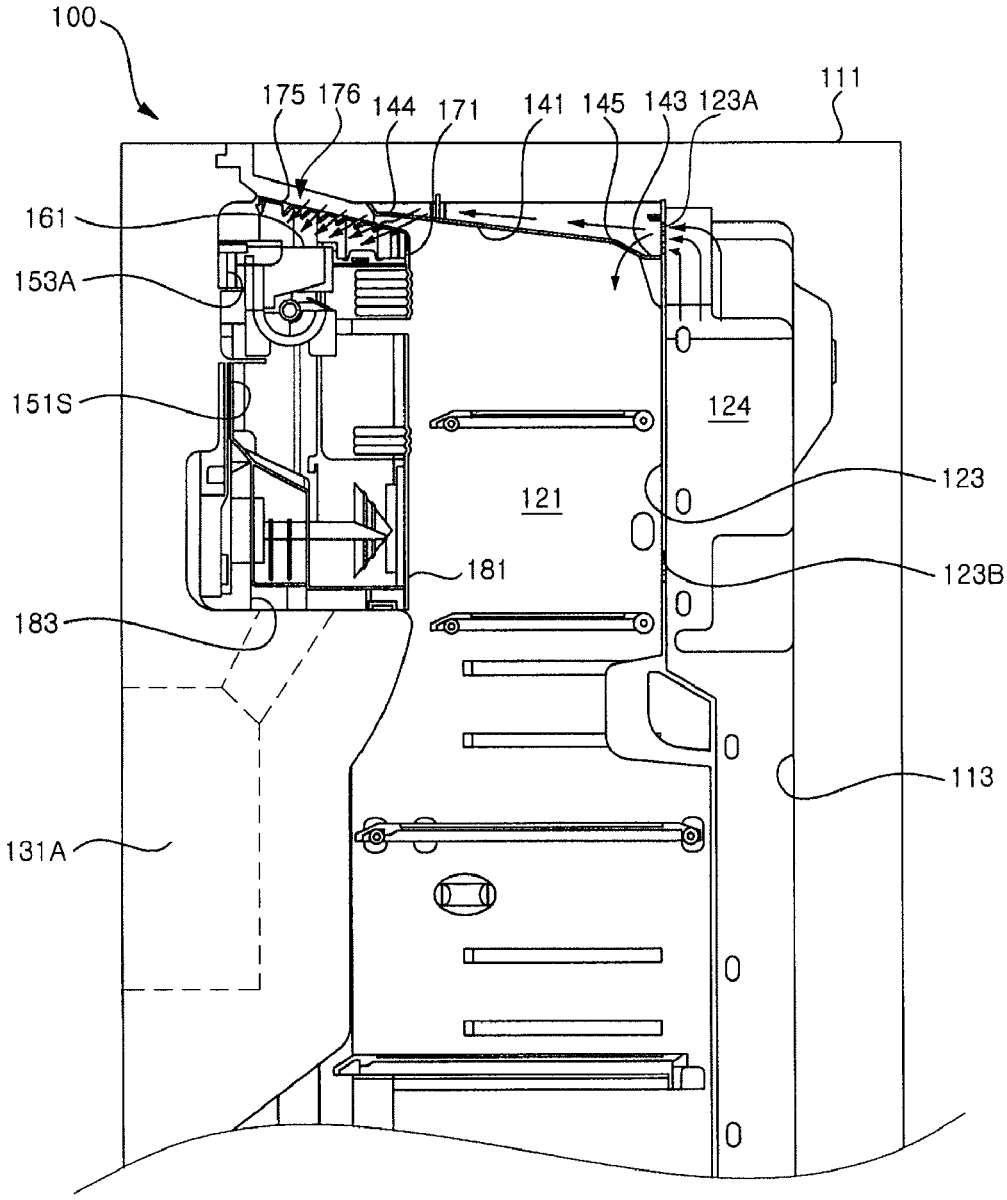
FIG. 7 is a side sectional view illustrating a process of flowing cold air and a process of feeding ice in the preferred embodiment of the present invention.
Figure 8:
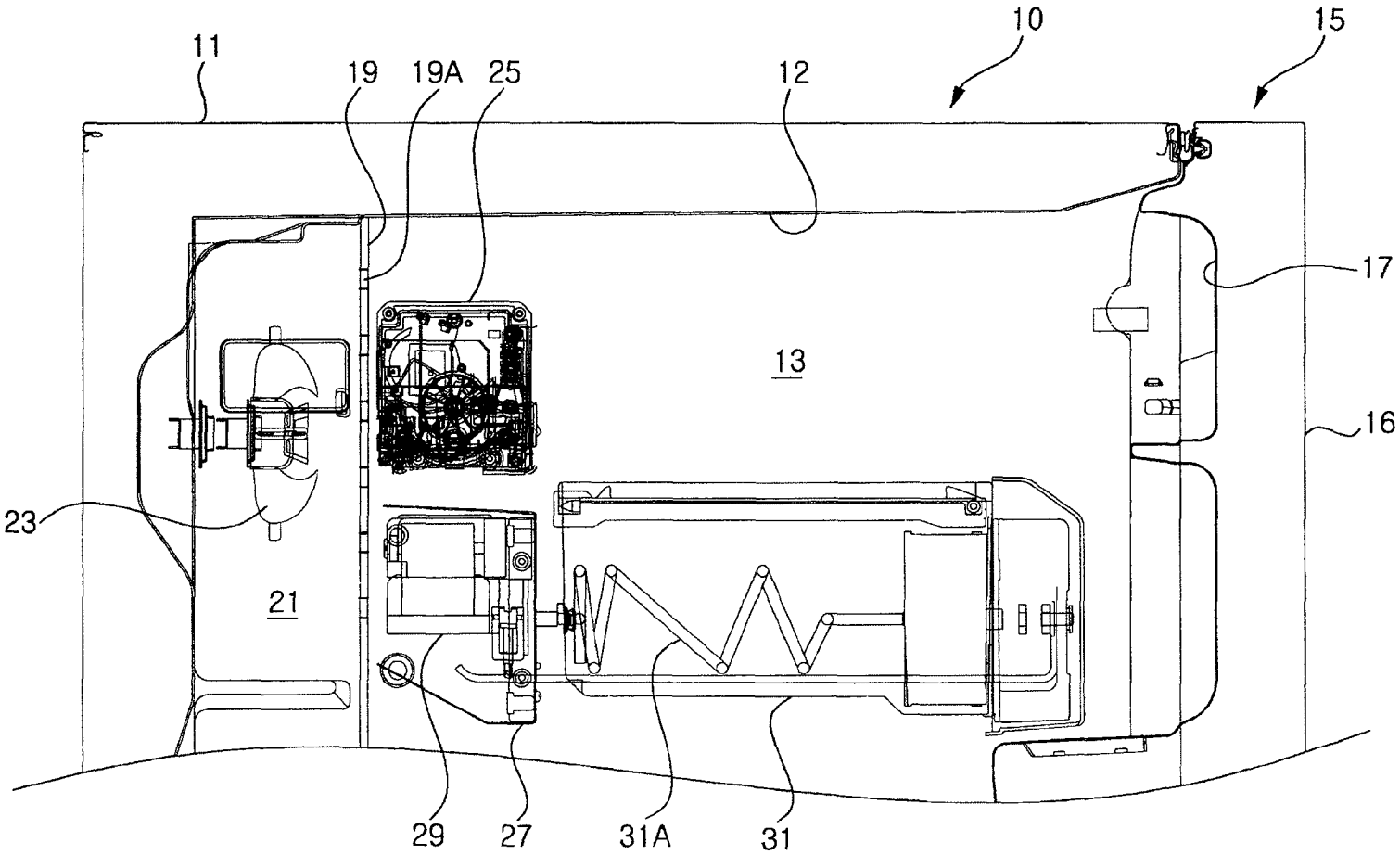
FIG. 8 is a side sectional view illustrating a major portion of a refrigerator provided with a conventional ice-making device.

FIG. 7 is a side sectional view illustrating a process of flowing cold air and a process of feeding ice in the preferred embodiment of the present invention.

As illustrated in the figure, when the air-blowing fan is driven, the cold air, which is heat-exchanged in the evaporator provided in the heat exchange camber 124, is discharged into the freezing chamber 121 through the cold air discharge holes 123A and 123B. Then, the cold air discharged through any one, e.g., the cold air discharge hole 123A, of the cold air discharge holes 123A and 123B is introduced into the cold air duct 141 through the cold air inlet 143.

A portion of the cold air introduced into the cold air duct 141 is supplied into the freezing chamber 121 through the auxiliary cold air outlet 145. Then, the remaining cold air introduced into the cold air duct 141 is supplied to the ice maker 161 positioned in the ice maker cover 171 through the cold air outlet 144 and the cold air introduction hole 175.

However, in a state where the freezing chamber 121 is closed by the freezing chamber door 131, the cold air duct 141 and the ice maker cover 171 are positioned to mate with each other in shape. Hence, the phenomenon is minimized that the cold air introduced into the cold air introduction hole 175 through the cold air outlet 144 flows out to the outside, i.e., to the inside of the freezing chamber 121. Furthermore, the cold air supplied to the ice maker 161 through the cold air introduction hole 175 is guided along the shortest route by the blades 176. Hence, the cold air is guided so as to be supplied to the ice maker 161 more efficiently by the blades 176.

In addition, a portion of the cold air guided by the blades 176 flows through a space between the front side of the installation space 151S and the ice maker 161 by the cold air guides 153A, and, then, is supplied to the ice maker 161. Hence, the cold air is also supplied smoothly to one side of the ice maker 161 corresponding to the opposite side to the cold air introduction hole 175.

Meanwhile, the ice made in the ice maker 161 is stored in the storage space 181S of the ice bank 181. Then, the ice is dispensed to the outside through the dispenser 131D by the manipulation of a user. At this time, the ice can be broken into pieces having a predetermined size according to the user's selection.

It will be apparent that those skilled in the art can make various modifications thereto within the scope of the technical spirit of the invention. The true scope of the present invention should be interpreted by the appended claims.

Industrial Applicability

According to the ice-making device for a refrigerator of the present invention so configured, the following advantages can be expected.

First, in the present invention, the ice maker is installed on the backside of the freezing chamber door. Hence, it is possible to prevent the phenomenon that a storage capacity of a storage space of a refrigerator, more particularly, a freezing chamber is lowered, thereby storing much more food in the freezing chamber.

Furthermore, according to the present invention, in a state where the ice maker is covered with the ice maker cover, a portion of the cold air supplied to the freezing chamber is supplied by the cold air duct, thereby making ice. Hence, in the process of making ice in the ice maker, it is possible to minimize the phenomenon that smell of other food stored in the freezing chamber permeates ice, whereby it is possible to make ice more hygienically.

In addition, according to the present invention, the ice bank that stores the ice made in the ice maker and transfers the ice to the dispenser is also installed on the backside of the freezing chamber door. Hence, it is possible to minimize the phenomenon that smell of other food permeates ice in a state where the ice is stored in the ice bank and at the same time to reduce the time required for supplying the ice through the dispenser.

The invention claimed is:

1. A method of assembling a refrigerator, comprising:

providing a main body having a storage chamber;

providing a door having a door liner on one side of the door;

providing a seating member;

providing an ice maker for making ice;

attaching the ice maker to the seating member;

attaching the seating member to the door liner;

providing an ice bank for storing ice;

attaching the ice bank to the seating member below the ice maker; and rotatably attaching the door to the main body.

2. The method according to claim 1, further comprising providing support steps extending at both sides of the door liner such that the supports steps define a space therebetween, wherein the step of attaching the seating member to the door liner includes positioning the seating member in the space between the support steps.

3. The method according to claim 2, further comprising:

providing a fixing protrusion on each of the support steps; and providing fixing recesses on the seating member, wherein the step of attaching the seating member to the door liner includes positioning the fixing protrusions in the fixing recesses.

4. The method according to claim 1, further comprising providing a round portion at a lower portion of the ice bank to permit the ice bank to be rotated about the lower portion when the ice bank is being installed on the seating member.

5. The method according to claim 1, further comprising:

providing an ice maker cover; and attaching the ice maker cover above the ice maker.

6. The method according to claim 4, further comprising providing a viewing window in the ice maker cover.

7. The method according to claim 1, further comprising:

providing a cold air duct having a cold air outlet; and attaching the cold air duct to the main body at a location within the storage chamber such that the cold air outlet is located above the ice maker when the door is in a closed position.

8. The method according to claim 7, further comprising providing a cold air passage extending downwardly between the ice maker and the seating member.

9. The method according to claim 1, further comprising:

providing a projection on the seating member; and providing a recess on the ice bank, wherein the step of attaching the ice bank to the seating member includes positioning the projection of the seating member within the recess of the ice bank

* * * * *